US005442254A

United States Patent [19]

Jaskie

[11] Patent Number: 5,442,254

[45] Date of Patent: Aug. 15, 1995

[54] FLUORESCENT DEVICE WITH QUANTUM CONTAINED PARTICLE SCREEN

[75] Inventor: James E. Jaskie, Scottsdale, Ariz.

[73] Assignee: Motorola, Inc., Schaumburg, Ill.

[21] Appl. No.: 55,889

[22] Filed: May 4, 1993

[51] Int. Cl.[6] ..... H01J 1/62; H01J 63/04

[52] U.S. Cl. ..... 313/485; 313/486; 313/503; 313/467; 315/169.3

[58] Field of Search ..... 313/485, 486, 503, 467; 315/169.3

[56] References Cited

U.S. PATENT DOCUMENTS

| | | | |
|---|---|---|---|
| 3,636,352 | 1/1972 | Wanmaker et al. | 313/486 |
| 3,707,642 | 12/1972 | Thornton, Jr. | 313/486 |
| 4,931,692 | 6/1990 | Takagi et al. | 313/503 |
| 4,950,948 | 8/1990 | Peters et al. | 313/486 |

OTHER PUBLICATIONS

A. P. Alivisatos et al., "Electronic States of Semiconductor Clusters: Homogeneous and Inhomogeneous Broadening of the Optical Spectrum", American Institute of Physics, pp. 4001–4011, Oct. 1, 1988.

S. Schmitt-Rink et al., "Theory of the Linear and Non Linear Optical Properties of Semiconductor Microcrystallites", The American Physical Society, vol. 35, No. 15, pp. 8113–8125, May 15, 1987.

V. Milanovic et al, "Electronic structure of Semiconductor Quantum Dots: Interband Transitions and Selection Rules", Superlattices and Microstructures, vol. 8, No. 4, pp. 475–480, Academic Press Ltd. 1990.

H. Arnot et al., "Photolumihescence Studies of GaAs-AlGaAs Quantum Dots", Microelectronic Eng'g 9, pp. 365–368, 1989.

Masamichi Yamanishi et al., "An Ultimately Low--Threshold Semiconductor Laser With Separate Quantum Confinements of Single Field Mode and Single Electron-Holefair", Japanese Journal of Applied Physics, vol. 30, No. 1A, pp. L60–L63, Jan. 1991.

J. N. Pafillon et al., "Enhancement of Intrmsic Photoluminescence Due to Lateral Confinement in InP/In GaAs Quantum Wires and Dots", American Institute of Physics, pp. 3789–3791, Oct. 1, 1990.

*Primary Examiner*—Sandra L. O'Shea
*Assistant Examiner*—Matthew J. Esserman
*Attorney, Agent, or Firm*—Eugene A. Parsons

[57] ABSTRACT

A fluorescent device, such as a fluorescent light or a CRT, is formed with a fluorescent screen including an optically transparent supporting substrate and a fluorescent layer deposited on the substrate. The fluorescent layer contains a plurality of particles each quantum confined by a size, generally below 100 Å dictated by a specific desired color of emitted light. Approximately 50 Å provides yellow light with larger particles moving toward red and smaller particles moving toward blue. A source of fluorescent stimulation, generally including electron bombardment or ultraviolet light, is mounted in spaced relation to the screen.

12 Claims, 2 Drawing Sheets

50

FLUORESCENT DEVICE WITH QUANTUM CONTAINED PARTICLE SCREEN

FIELD OF THE INVENTION

The present invention pertains to devices utilizing fluorescent screens and more particularly to high efficiency fluorescent screens.

BACKGROUND OF THE INVENTION

In the conventional fluorescent lamp, an electric glow discharge is created between the positive and negative terminals. The interelectrode space is filled with a gas, commonly a low pressure mercury vapor, that is selected to emit ultraviolet (UV) radiation when the discharge state is energized. This ultraviolet light is used to stimulate a 'phosphor' that is coated on the walls of the glass tube.

The word 'phosphor' is a term of art in that, contrary to expectations, a 'phosphor' need not contain phosphorous. The term is left over from the previous century when these materials typically did contain the element phosphor. The phosphor, when stimulated by UV light or an electron beam, emits visible light or a range of visible light. This visible light is the light commonly used to light offices, homes, to backlight LCD displays and even to light up the display on the CRTs in televisions and computer monitors. The efficiency of the glow discharge creation, the efficiency at which the UV light is created by the glow discharge, and the efficiency at which the phosphor utilizes the UV light to create visible light all act together in a multiplicative manner to create the overall efficiency of the lamp. The electrical energy that is consumed but not utilized to produce visible light is reduced to heat and becomes a thermal burden. This problem is important in office lighting but is critical in the use of fluorescent lamps for backlighting LCD displays. In these displays, the backlight is often the largest energy user, consuming more power than the computer, hard-disk, and the rest of the display.

Phosphors that photoluminesce were originally discovered by the German physicist Johann Wilhelm Ritter in 1801. The photoluminescent materials are used in so many high volume devices today that there has been a large research effort in this field over the last fifty years. This effort has pushed the luminescence properties of these materials to their physical limits.

The emission of visible light (between 400 nm and 690 nm) requires excitation energies which are, at their minimum, given by $$E = \frac{hc}{\lambda}$$

where: $\lambda$ is the wavelength of the specific desired color; c is the speed of light; and h is Planck's constant. The minimum energy required for excitation therefore ranges from 1.8 eV to 3.1 eV.

The excitation energy is transferred to electrons which jump from their ground-state energy level to a level of higher energy. The allowable energy levels are specified by quantum mechanics. The excitation mechanisms are typically the impact of accelerated electrons, positive ions or photons. In a typical color TV, the excitation is created by 30,000 eV electrons. The wavelength of the emitted light is typically independent of varying levels of input energy by these accelerated particles and is usually a function of the phosphor material only. The input particle energy can, however, affect the efficiency of conversion. That is, how many emitted photons are created by the incoming particle.

In fluorescent lamps, a Mercury atom is excited by the impact of an electron having an energy of at least 6.7 eV. This raises one of the two outermost electrons of the Mercury atom from the ground state to a higher, excited state. Upon spontaneous collapse of the electron from this higher state back to the ground state, the energy difference is emitted as UV light having a wavelength of 185 nm, or 254 nm, depending on the particular states involved. A phosphor coating on the lamp tube, such as Calcium Halophosphate with a heavy metal activator such as Antimony or Manganese, is stimulated by this UV photon and, undergoing a similar process, reradiates visible light.

In a solid, such as the phosphor coating, the electronic energy states form bands. In the ground state, most of the carriers are found in the valence band. After excitation by an incoming particle such as an electron or photon, the carriers are elevated in energy into the conduction band. The energy gap between the valance band and the conduction band is equal to the energy of a UV photon. The 'activators' are elements or defects that cause energy levels bridging the gap between the valance and conduction bands. When an electron is in one of these states it can return to the ground state by releasing this energy as a photon of visible light. These activation centers can be excited by either direct bombardment by photons or electrons, or by energy transfer from elsewhere in the bulk. The creation of excitons (ion-electron pairs) can occur some distance from the activation site and these excitons can drift to the activation center where the photon emission process can occur. Energy transfer can also take place in the optical domain by the emission of a photon from an initial activation site. This intermediate photon then induces emission of a new photon from a different site.

If when each energetic photon enters a phosphor, it creates one photon of a lower energy, the quantum efficiency is 100%. But its luminescent efficiency is less than 100%. If each incoming photon creates, on average, less than one new photon, then its quantum efficiency is less than 100%. The quantum efficiency of most phosphors is much less than 100%; common Zinc Sulfide phosphors are about 20% efficient and the luminescent efficiency is less than 20%.

The limits in performance in this "classical" phosphor mechanism are that one must pick the phosphor and activator structure to obtain the desired color. This selection is comparable to selection rules in spectroscopy in that the color is not readily adjustable through common industrial techniques such as varying doping concentrations. Instead, different activators or host matrices must be used, along with the attendant differences that go with the selection and materials. The efficiencies obtained are also regrettably low, generally well below 20% energy in/energy out. The engineering results of these problems are poor colors, heat generation and poor battery life.

SUMMARY OF THE INVENTION

Accordingly, it is a purpose of the present invention to provide a new and improved fluorescent device with a quantum contained particle screen.

It is a further purpose of the present invention to provide a new and improved fluorescent device with quantum contained particle screen in which the color of the visible light emissions can be easily modified.

It is a further purpose of the present invention to provide a new and improved fluorescent device with quantum contained particle screen in which the color of the visible light emissions can be easily modified without effecting the efficiency or cost.

The above problems and others are substantially solved and the above purposes and others are realized in a fluorescent device with quantum contained particle screen including a source of fluorescent stimulation, and a fluorescent screen mounted in spaced relation to the source, the fluorescent screen including an optically transparent supporting substrate and a fluorescent layer deposited on the substrate and containing a plurality of particles each quantum confined by a size dictated by a specific desired color of emitted light.

The above problems and others are further substantially solved and the above purposes and others are further realized in a method of manufacturing a fluorescent device with quantum contained particle screen comprising the steps of forming a fluorescent screen including providing an optically transparent supporting substrate, providing a plurality of particles each quantum confined by a size dictated by a specific desired color of emitted light and fixedly depositing the plurality of particles on a surface of the supporting substrate in a fluorescent layer, providing a source of fluorescent stimulation, and mounting the source of fluorescent stimulation in spaced relation to the screen.

BRIEF DESCRIPTION OF THE DRAWINGS

Referring to the drawings.

DESCRIPTION OF THE PREFERRED EMBODIMENT

A relatively recent development in material science has been the ability to fabricate structures that are small on a quantum scale. On this small scale, 100 Å or less,- the applicable physics is no longer that of the solid state bulk nor that of the gaseous free atom, but rather that of a quantum confined intermediate. Because of the small sizes, smaller than that of an exciton, unusual optical effects are also present. Early in the development these small scale structures were formed in layers with lateral confinement only. The lateral confined structures are typically composed of thin layers produced by MBE equipment on GaAs or other active substrates. As an example of a use of these thin layers, lasers have been made that utilize the quantum confinement layers for carrier confinement or refractive optical confinement. The techniques for the production of very thin layers of material with reasonable electronic mobilities require very meticulous crystal growth and exceedingly high purity.

Figure 1:
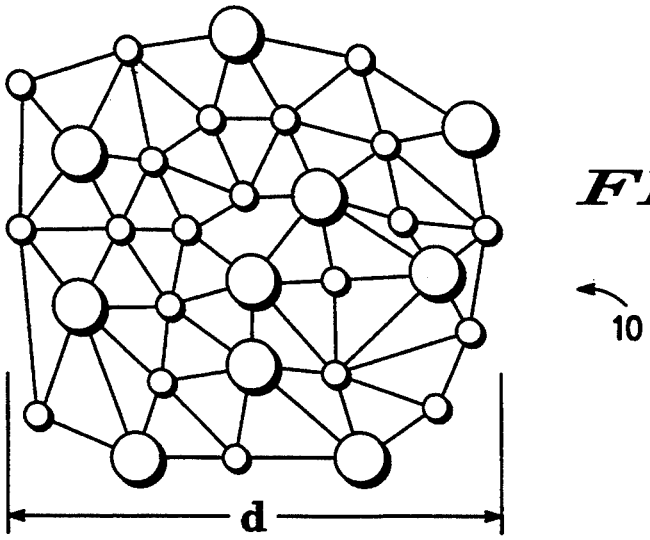
FIG. 1 is a simplified representative view of a greatly enlarged quantum contained particle.

Referring specifically to FIG. 1, a quantum structure herein referred to as a quantum contained particle 10 is illustrated. Quantum contained particle 10 is a small particle of material, e.g., semiconductor material, that is small enough to be quantum confined in three dimensions. That is, quantum contained particle 10 has a diameter, d, that is only about 100 Å or less. This creates a three dimensional well with quantum confinement and symmetry in all directions.

In the general case where a particle is restricted to a small box, it is impossible to obtain analytical solutions to the Shroedinger equation:

$$\frac{-h^2}{2M}\nabla^2\Psi(x,y,z) + (V - E_0)\Psi(x,y,z) = 0$$

But in a simple case, that of a particle which is confined within a rectangular box but is otherwise free, the equation is solvable. Assuming simple boundary conditions such that the walls of the box are completely impenetrable to the particle, the potential energy is infinite outside of the box, and zero inside of the box, the equation becomes solvable. These assumptions are obviously incorrect, but are useful for illustrative purposes.

Hence, $$\Psi(x,y,z,)=0$$

at each wall. Clearly, the wave function must be of the form $$\Psi(x,y,z,) = A\sin\left(\frac{l\pi x}{a}\right)\sin\left(\frac{m\pi y}{b}\right)\sin\left(\frac{n\pi z}{c}\right)$$

Where the box is defined by x=0, x=a, y=0, y=b, z=0, z=c And the energy eigenvalues corresponding to the eigenfunctions are $$E_{lmn} = \frac{h^2\pi^2}{2M}\left(\frac{l^2}{x^2} + \frac{m^2}{y^2} + \frac{n^2}{z^2}\right)$$

Note that this solution allows many different energy levels, one for each combination of l, m, and n, where these are integers. However, these are separate, distinct energy levels. The solution for this quantum confined box or particle is very different than that for the bulk, where the spatial limits a, b and c are effectively infinitely far away. In the bulk case, the result is continuous bands of allowed levels, whereas the confined system has completely discreet bound states. The dimensions, a, b and c, of the particle determine the allowed energy levels or emitted energy frequency. The discreteness of the allowable energy levels strongly restricts the perturbations that will allow transitions between levels.

Therefore, there is the possibility that an electron excited to a higher-lying level can have a very long lifetime, almost exclusively determined by the radiative transition rate. This possibility of long lifetime in excited states has great potential for optical devices. It should be noted that in these structures the eigenvalues are defined by geometric and fundamental quantities, not by material, atomic, or crystalline properties. In quantum contained particle 10, the simple assumptions of zero internal potential energy and infinite external potential energy is modified by overlapping and extending wavefunctions that are dependent on the material properties and constituent atoms to some extent. However, to a large extent the properties of quantum contained particle 10 are designed by selecting the size and geometry.

This leads to some surprising features of quantum contained particle 10, especially the strength of the optical properties. The quantum efficiency of luminescence has been found to be larger in quantum structures formed from GaAs/GaAlAs, GaInAs/AlInAs, ZnSe/ZnMnSe, and others than in the bulk of the same material.

Examination of the interaction between electrons and photons illustrates why this happens. Careful consideration of the interaction requires perturbation techniques. The properties of the system are calculated in the absence of electromagnetic radiation, and the modification that occurs with the radiation is then calculated. If the problem allows convergent techniques, the solutions can be obtained. Solutions of Shroedinger's equation with a perturbation harmonic in time of the form $$H^I(r,t)=H^I(r)\cos\omega t$$

gives a transition probability $$B_{12}=\left[\frac{\pi}{2h}\right]|<(\Psi_1{}^*(x,y,z,t)|H^I|\Psi_2(x,y,z,t))>|$$

which is called Fermi's Golden Rule. Where $\Psi_1{}^*(x,y,z,t)$ is the complex conjugate of the wave function of the initial state, $H^I$ the interaction Hamiltonian and $\Psi_2(x,y,z,t)$ the wave function of the final state. Or, rewriting, $$B_{12}=\left[\frac{2\pi}{h}\right]\sum_{fi}|<f|H^I|i>|^2\,\delta(E_f-E_i+h\omega)$$

where i, f are initial and final states with energies $E_i$ and $E_f$. $H^I$ is approximated with the electric dipole $-er\cdot E$. The summation over the initial and final states presents the reduced density of state.

Another useful quantity is the oscillator strength of the electric dipole transition between states i and f.

$$f_{if}=\frac{2M\omega}{h}\,|<f|\eta\cdot r|i>|^2$$

The oscillator strength is related to many different properties of these materials, such as the dielectric function (Debye Eqn.)

$$\epsilon(\omega)=1+\sum_j\frac{4\pi e^2}{M}\;\frac{f_{if}}{(\omega_j^2-\omega^2)-i\gamma_j\omega}$$

where the summation is performed over all transitions j and $\gamma_j$ is a damping factor. Transition energies are spread over energy bands instead of occurring at a single energy. Optical effects described by the dielectric function are quite diminished when dealing with resonant or non resonant excitations due to this spreading.

In quantum contained particle 10, the oscillator strength is not actually increased over its bulk level. The density of allowable states is instead greatly reduced, through the quantum confining effect. This creates a better matching of electron and hole wavefunctions. This behavior, the progressive restriction of allowed states over the energy bands, and more and more single energy atom-like levels as the particles become smaller, is the basis for all of the optical phenomena in quantum contained particle 10.

The sharp atom-like energy levels enormously sharpens all resonant behavior, and leads to lower dispersion of optical properties over different states. The energy per electron is no greater, nor is the energy emission per transition greater, than in the large dimension case. However, concentrating carriers in quantum contained particle 10 leads to a larger maximum in the transition statistics because of the fewer allowable transitions. Basically all the carriers have the same allowed states in both space and energy. Thus, quantum contained particle 10 luminesces more efficiently than bulk materials because it does not possess other mechanisms, i.e. non radiative recombination centers, as do bulk materials.

Figure 2:
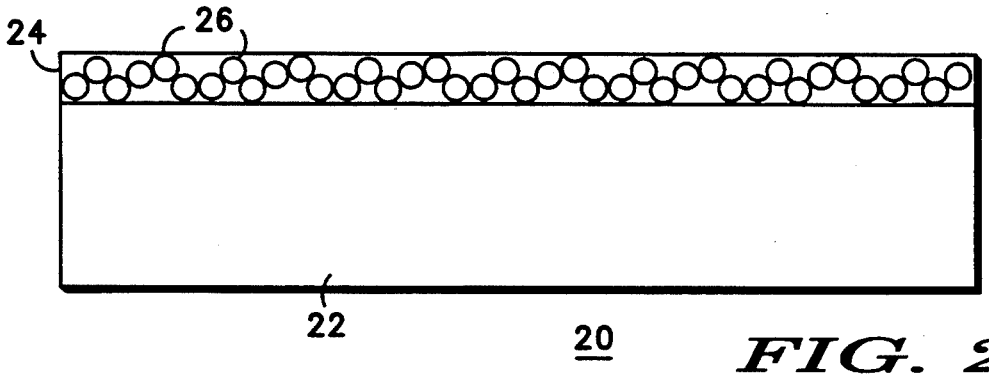
FIG. 2 is sectional view of a portion of a fluorescent screen embodying the present invention.

Referring specifically to FIG. 2, a fluorescent screen 20 is illustrated, including an optically transparent supporting substrate 22 and a fluorescent layer 24 deposited on substrate 22. Substrate 22 may be any convenient material, such as glass, optically transparent semiconductor material, optically transparent plastic, etc. Fluorescent layer 24 includes a plurality of quantum contained particles 26, similar to quantum contained particle 10, fixedly deposited on the surface of supporting-substrate 22. Plurality of quantum contained particles 26 are fixedly deposited on the surface of substrate 22 by any convenient means such as: a thin film of uncured, optically clear plastic which is spread on the surface, particles 26 are spread over the surface of the thin film and the film of plastic is cured; an adhesive; a solution of material, e.g. magnesium oxide hydrate, and particles 26 are used to form layer 24 on substrate 22, after which the solution is allowed to dry; etc.

As stated above, the properties of quantum contained particles 26 are designed chiefly by selecting the size (diameter d). Because the dimensions of particles 26 determine the allowed energy levels, the color of generated light is determined by the size of particles 26. Thus, the color of the emitted light of fluorescent screen 20 is adjusted, or tuned, by adjusting the size distribution of particles 26 during manufacture. As an example, yellow to a yellow orange light is produced when quantum contained particles 26 have a size (diameter d) of approximately 50 Å. By reducing the size of quantum contained particles 26, the emitted color is moved toward the blue end of the color spectrum and by increasing the size, the emitted color is moved toward the red end of the color spectrum, with the maximum size being approximately 100 Å. Further, light emission by fluorescent layer 24 is brighter, for the same stimulation level as required for standard fluorescent screens, or alternatively, the same brightness is achieved for less input energy. Therefore, fluorescent screen 20 presents the opportunity for far more sensitive color engineering than is possible with prior art fluorescent screens and with significantly increased energy efficiency.

There are presently a wide variety of methods for manufacturing quantum contained particles, at least one of which uses a Micelle technique that basically allows the particles to be made in a bucket using wet chemistry. The Micelle technique is a method of precipitation in a fluid in the presence of a stabilizer that binds to the growing crystal, preventing further growth or agglomeration. In a specific example, spherical CdS nanocrystals are prepared with the particle surfaces being terminated with either thiophenol or mercaptoactic acid. The thiophenol-capped particles are prepared using inverse micelles. In this method, the colloids are isolated as a dry powder which can br redissolved in pyridine. Water soluble particles are synthesized by the combination of $CdCl_2$ and mercaptoacetic acid which gives an extended complex that is destabilized by a change in pH, followed by addition of $Na_2S$. Variations in size are generally in the range of ±7% in diameter. The micelle technique is described in more detail in a preprint entitled "Observations of Melting in 30 Å Diameter CdS Nanocrystals" by A. N. Goldstein, V. L. Colvin, and A. P. Alivisatos, which appeared in "Clusters and Cluster Assembled Materials", Materials Research Society Symposium Proceedings, Fall 1990. Other methods include common etching techniques. For example, silicon quantum confined structures are made by providing (100) substrates of 10 ohm-cm p-type silicon wafer with metallization on the back side (over a p++ boron layer of ohmic contact). Electrochemical anodization in solutions containing 10–40% HF and at current densities of 10–50 $mA/cm^2$. Structures down to 10 Å can be obtained by varying the electrochemical parameters. The shape and texture of the structures are controlled by material resistivity.

The tuning (size selection) is also accomplished in a variety of ways, at least one of which includes a wet filtering technique. The quantum contained particles (of all sizes) are suspended in a wet mixture. One end of a cloth is immersed in the liquid and the mixture is allowed to move up the cloth by capillary action, aided by an electric field if desired. The quantum contained particles will move up the cloth a distance directly proportional to their size. Thus, at a predetermined height on the cloth all of the quantum contained particles will be substantially the same size. Utilizing this or a similar technique the quantum contained particles can be easily separated into desired sizes.

Figure 3:
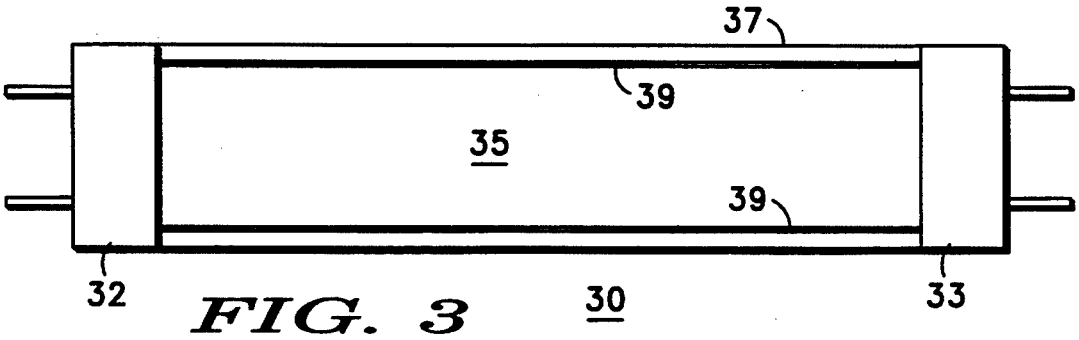
FIG. 3 is a sectional view of a fluorescent bulb embodying the present invention.

Referring specifically to FIG. 3, a fluorescent bulb 30 is illustrated. Bulb 30 includes ends 32 and 33 containing the usual ballast and starter circuits adapted to be engaged in an electrical socket of a fluorescent lamp in a well known manner. Ends 32 and 33 create the usual glow discharge in interelectrode space 35. Space 35 is filled with a low pressure mercury vapor that emits ultraviolet radiation when the electric glow discharge is created. Space 35 is defined and sealed by an elongated tubular glass envelope 37 which extends between ends 32 and 33. Glass envelope 37 acts like a supporting substrate for a layer 39 of fluorescent material deposited on the inner surface thereof. Layer 39 includes a plurality of quantum contained particles, as described in conjunction with FIG. 2. Envelope 37 and layer 39 form a fluorescent screen which, in conjunction with the source of fluorescent stimulation provided by the ultraviolet light emitted by the mercury vapor, emit a light, the color of which is determined by the size of the quantum contained particles in layer 39.

Figure 4:
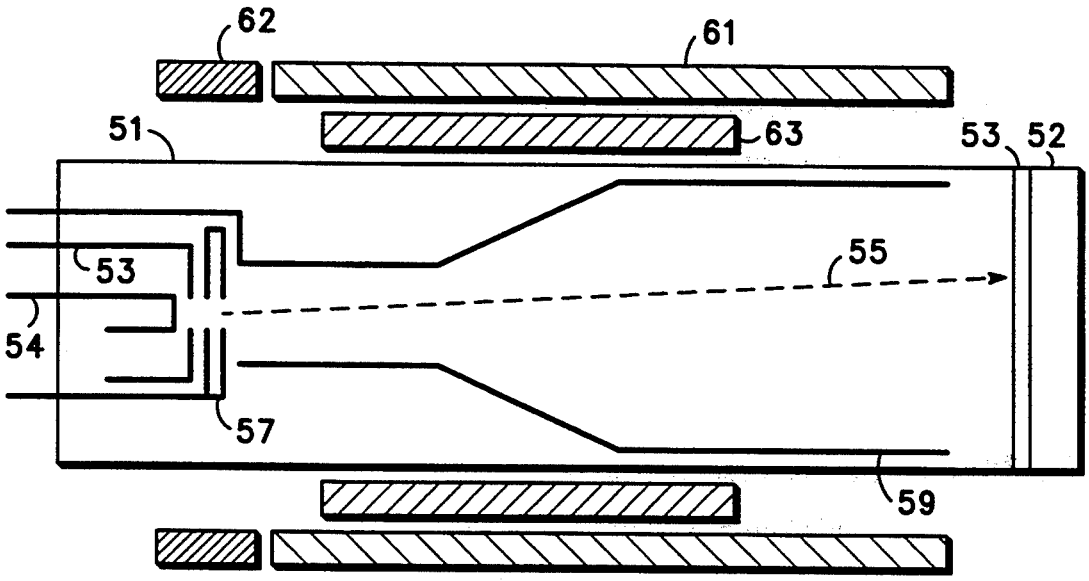
FIG. 4 is a sectional view of a CRT embodying the present invention.

Referring specifically to FIG. 4, a sectional view of a CRT 50 embodying the present invention is illustrated. A simplified representation of a deflection system is also illustrated to better understand the stimulation source. In this embodiment a portion of CRT 50 resides in an evacuated region typically defined by an encapsulating glass envelope 51. A faceplate 52 is provided on which is disposed a layer 53 of fluorescent material. Layer 53 includes a plurality of quantum contained particles similar to that described in conjunction with FIG. 2. Any desired color of the emitted light of fluorescent screen 53 is achieved by adjusting the size distribution of the quantum contained particles during manufacture.

A thermionic cathode 54 provides an electron beam 55 to stimulate emission from layer 53. The rate of electron emission is regulated by an attendant grid 56. An acceleration grid 57 and focusing grid 59 are provided to complete the structure disposed within the confines of glass envelope 51. External to glass envelope 51 and integral to the operation of CRT 50 are a focusing coil 61, an alignment coil 62, and deflection coils 63, which influence the trajectory and characteristics of electron beam 55. So constructed, electron beam 55 forms a source of fluorescent stimulation and is systematically scanned over a surface of layer 53 to provide a desired image, in a well known manner.

Figure 5:
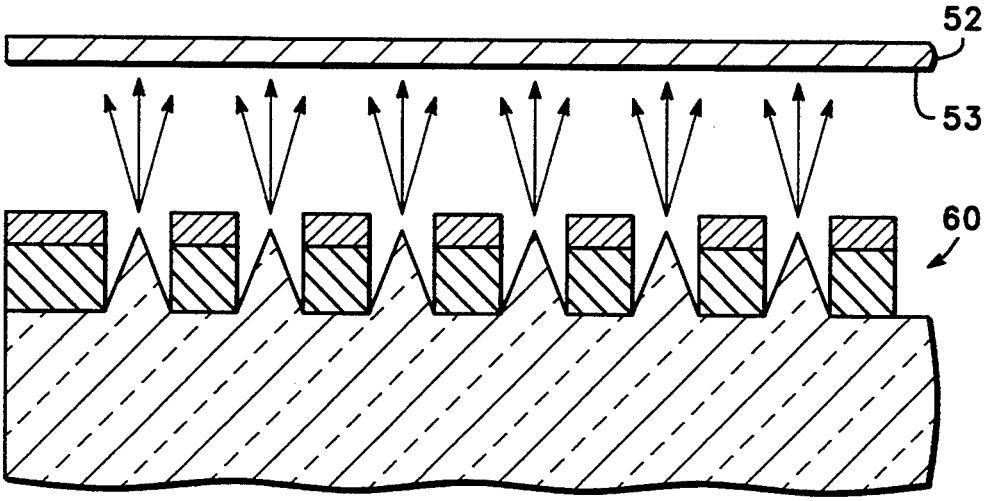
FIG. 5 is a sectional view similar to FIG. 4 wherein the CRT electron gun has been replaced with an array of FEDs.

Referring specifically to FIG. 5, a sectional view similar to FIG. 4 is illustrated wherein the electron gun and focusing portions of the CRT have been replaced with a standard array of FEDs as disclosed, for example, in U.S. Pat. No. 5,212,426, issued May 18, 1993 and entitled Integrally Controlled Field Emission Flat Display Device. In FIG. 5, faceplate 52 having fluorescent screen 53 disposed thereon is activated by electron emissions from an array of field emission devices (FED) 60 similar to the above description of CRT 50.

Thus, a new and improved fluorescent device with quantum contained particle screen and method for making the screen have been disclosed. Further, a new and improved quantum contained particle screen is disclosed in which the color of the visible light emissions can be easily tuned during manufacture. Also, a new and improved quantum contained particle screen is disclosed in which the efficiency of the light emissions is greatly improved. The process for manufacturing and tuning the quantum contained particles is very simple and so inexpensive that it is expected that they can be manufactured for no more cost, or even less, than current phosphors.

While I have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

What is claimed is:

1. A fluorescent device with quantum contained particle screen comprising:

a source of fluorescent stimulation; and a fluorescent screen mounted in spaced relation to the source, the fluorescent screen including an optically transparent supporting substrate and a fluorescent layer deposited on the substrate, the fluorescent layer containing a plurality of particles each quantum confined by a diameter dictated by a specific desired color of emitted light.

2. A fluorescent device with quantum contained particle screen as claimed in claim 1 wherein the optically transparent substrate is glass.

3. A fluorescent device with quantum contained particle screen as claimed in claim 1 wherein the source of fluorescent stimulation is an ultraviolet light source.

4. A fluorescent device with quantum contained particle screen as claimed in claim 3 wherein the fluorescent device is a fluorescent bulb for a fluorescent light and the ultraviolet light source is an ionized gas within the fluorescent bulb.

5. A fluorescent device with quantum contained particle screen as claimed in claim 1 wherein the source of fluorescent stimulation is an electron bombardment source.

6. A fluorescent device with quantum contained particle screen as claimed in claim 5 wherein the electron bombardment source includes field emission devices.

7. A fluorescent device with quantum contained particle screen as claimed in claim 5 wherein the fluorescent device is a cathode ray tube and the electron bombardment source is an electron gun.

8. A fluorescent device with quantum contained particle screen as claimed in claim 1 wherein the specific desired color dictates a minimum energy required for excitation in accordance with $$E = \frac{hc}{\lambda}$$

where: $\lambda$ is the wavelength of the specific desired color; c is the speed of light; and h is Planck's constant, the excitation energy, E, being approximately determined by $$E_{lmn} = \frac{h^2\pi^2}{2M}\left(\frac{l^2}{x^2} + \frac{m^2}{y^2} + \frac{n^2}{z^2}\right)$$

where: $E_{lmn}$ is the eigenvalue corresponding to the eigenfunctions l, m and n; x, y and z are dimensions of each particle of the plurality of particles; and M is the effective mass of an electron to be excited.

9. A fluorescent device with quantum contained particle screen as claimed in claim 8 wherein the x, y and z dimensions are each less than approximately 100 Å.

10. A fluorescent device with quantum contained particle screen as claimed in claim 1 wherein the diameter dictated by a specific desired color of emitted light is less than approximately 100 Å.

11. A fluorescent device with quantum contained particle screen as claimed in claim 1 wherein each particle of the plurality of particles includes a semiconductor material.

12. A fluorescent device with quantum contained particle screen as claimed in claim 11 wherein the semiconductor material includes silicon.

* * * * *